US011284207B2

(12) United States Patent
Fichtl et al.

(10) Patent No.: US 11,284,207 B2
(45) Date of Patent: Mar. 22, 2022

(54) SUPPLEMENTARY SOUND CLASSES FOR ADJUSTING A HEARING DEVICE

(71) Applicant: SONOVA AG, Staefa (CH)

(72) Inventors: Elmar Fichtl, Hombrechtikon (CH); Ullrich Sigwanz, Hombrechtikon (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 17/256,863

(22) PCT Filed: Jul. 5, 2018

(86) PCT No.: PCT/EP2018/068283
§ 371 (c)(1),
(2) Date: Dec. 29, 2020

(87) PCT Pub. No.: WO2020/007478
PCT Pub. Date: Jan. 9, 2020

(65) Prior Publication Data

US 2021/0258706 A1 Aug. 19, 2021

(51) Int. Cl.
*H04R 25/00* (2006.01)

(52) U.S. Cl.
CPC ..... *H04R 25/70* (2013.01); *H04R 25/505* (2013.01); *H04R 2225/41* (2013.01); *H04R 2225/55* (2013.01)

(58) Field of Classification Search
CPC .. H04R 25/70; H04R 25/505; H04R 2225/41; H04R 2225/55
(Continued)

(56) References Cited

U.S. PATENT DOCUMENTS

2001/0055397 A1* 12/2001 Norris ..... G10H 1/0091 381/79
2003/0215103 A1* 11/2003 Norris ..... H04B 11/00 381/77
(Continued)

FOREIGN PATENT DOCUMENTS

EP 1523219 4/2005
EP 2201793 3/2011
(Continued)

OTHER PUBLICATIONS

International Search Report and Written Opinion received in International Application No. PCT/EP2018/068283.
(Continued)

*Primary Examiner* — Sean H Nguyen
(74) *Attorney, Agent, or Firm* — ALG Intellectual Property, LLC

(57) ABSTRACT

A method for adjusting at least one hearing device comprises: providing the at least one hearing device with basic sound classes, each basic sound class comprising an actuator parametrization with parameters for at least one actuator of the hearing device; collecting of adjustments of sound properties of at least one user of the at least one hearing device together with weightings of a sound signal acquired by the hearing device at which the adjustments have been made; analyzing the collected adjustments, whether same adjustments have been applied at same weightings; generating at least one supplementary sound class, when the same adjustments have been applied at a weighting, wherein the actuator parametrization of the supplementary sound class is a modified actuator parametrization based on the adjustments at the weighting.

15 Claims, 6 Drawing Sheets

(58) Field of Classification Search
USPC ..... 381/60
See application file for complete search history.

(56) References Cited

U.S. PATENT DOCUMENTS

| | | | | |
|---|---|---|---|---|
| 2011/0123056 | A1 | 5/2011 | Aboulnasr et al. | |
| 2014/0294212 | A1 | 10/2014 | Barthel | |
| 2014/0314261 | A1* | 10/2014 | Selig | A61B 5/6898 381/314 |
| 2015/0146876 | A1 | 5/2015 | Nishizaki | |
| 2016/0373869 | A1* | 12/2016 | Gran | H04R 25/558 |

FOREIGN PATENT DOCUMENTS

| | | |
|---|---|---|
| WO | 2008155427 | 12/2008 |
| WO | 2015024585 | 2/2015 |

OTHER PUBLICATIONS

Lamarche, et al., Adaptive Environment Classification System for Hearing Aids, The Journal of the Acoustical Society of America, American Institute of Physics for the Acoustical Society of America, New York, NY, US, vol. 127, No. 5, May 1, 2010, pp. 3124-3135.

* cited by examiner

SUPPLEMENTARY SOUND CLASSES FOR ADJUSTING A HEARING DEVICE

FIELD OF THE INVENTION

The invention relates to a method, a computer program and a computer-readable medium for adjusting at least one hearing device. Furthermore, the invention relates to a hearing system.

BACKGROUND OF THE INVENTION

Hearing devices are wearable devices, which aim to improve the hearing experience of the person wearing the hearing device. If the hearing device is a hearing aid it is adapted to compensate a hearing loss of the person wearing the hearing aid, i.e. the user. A hearing device may comprise a microphone and a loudspeaker, wherein audio input at the microphone may be frequency dependent filtered and/or amplified for compensating the hearing loss. The modified audio signal is then output by the loudspeaker, which may be located near or in the ear channel of the user.

The filtering of the hearing device may be performed by a set of actuators, which differently modify the audio signal. Each actuator may be seen as a specific filter and/or may be tuned with one or more parameters, which have impact on the filtering of the actuator. For example, an actuator may amplify the audio signal in a range around a specific frequency and the specific frequency and the width of the range may be the parameters for tuning the actuator.

Specific hearing devices may automatically identify sound situations, may classify these sound situations and may provide an appropriate actuator parametrization for these sound classes. The sound situations may be classified into predefined sound classes, each of which is associated with a special set of parameters for the actuators, i.e. an actuator parametrization or actuator setting. Sound classes are usually defined with the audiological knowhow of experts. Sound classes may be revised, if fitters or users systematically complain about issues, which can be related to the given sound class structure and/or if new opportunities for better handling certain situations are found.

The classification of the sound classes may be performed with one or more classifiers of the hearing device, which evaluate the sound signal to be processed by the hearing device. There are classifiers, which may also identify sound situations, which are mixtures of the sound classes. In this case, the actuator parametrization of involved sound classes may be determined by linearly mixing the actuator parametrization.

If such a mixed actuator parametrization does not suit the demands of the user of the hearing device, the actuator parametrization of the involved sound classes may be adjusted by an audiologist. However, such a modification may be very unspecific and may lead to unwanted effects on other sound situations, which are also affected by such a modification. On the other hand, the user may be forced to repeatedly adjust his or her hearing device, which may decrease the satisfaction of the user.

In WO 2008/155427 A2, a method for operating a hearing device is presented, where the hearing device is continuously learnable for the particular user. A sound environment classification system is provided for tracking and defining sound classes relevant to the user. In an ongoing learning process, the classes are redefined based on new environments to which the hearing device is subjected by the user.

In EP 1 523 219 A2, a method for training and operating a hearing device is described. With the method, a detection rate of a classifier may be increased by assigning detected signals to specific hearing situations.

DESCRIPTION OF THE INVENTION

It is an objective of the invention to provide a hearing device that is more easily adapted to the needs of a user. It is a further objective of the invention to simplify the adjustment of a hearing device for a user of the hearing device and/or to decrease the situations, in which a user adjusts the hearing device.

These objectives are achieved by the subject-matter of the independent claims. Further exemplary embodiments are evident from the dependent claims and the following description.

A first aspect of the invention relates to a method for adjusting at least one hearing device. The method may be performed automatically by a hearing device and/or may be performed by a system collecting data from one or more hearing devices. For example, the system may be connected to a plurality of hearing devices via Internet.

According to an embodiment of the invention, the method comprises: providing the at least one hearing device with basic sound classes, each basic sound class comprising an actuator parametrization with parameters for at least one actuator of the hearing device; collecting of adjustments of sound properties together with weightings at which the adjustments have been made; analyzing the collected adjustments, whether same adjustments have been applied at same weightings; and generating at least one supplementary sound class, when the same adjustments have been applied at a weighting, wherein the actuator parametrization of the supplementary sound class is a modified actuator parametrization based on the adjustments at the weighting.

These method steps may be performed by the hearing device itself and/or an external system, such as a server system that is communicatively interconnected with the hearing device: In the case of an external system, which generates the supplementary sound class, the method furthermore may comprise: providing the at least one hearing device with the at least one supplementary sound class.

Examples for basic sound classes are "calm situation" (CS), "speech in noise" (SpiN), "noise" (N), "music" (Mu), etc. In general, the sound class structure of a hearing device may differentiate between several sound classes, like single sound source situations, calm situations, situations with speech, situations with background sound, noise and/or music, etc. The sound class structure may be the set of basic and supplementary sound classes optionally in combination with an interpolation structure (see below) storing the sound classes.

Each basic sound class and also a supplementary sound class, as described below, comprises an actuator parametrization, i.e. a set of specific parameters or settings for the actuators of the hearing device. Examples for actuators are a gain steerer, a noise canceller, a beam former, etc. For example, a beam former may amplify sound from a specific direction and/or may attenuate sound from other directions. Parameter for a beam former to be set may be the direction and/or the width of the beam.

The actuator parametrization for a basic sound class may be predefined by the hearing device manufacturer and/or may be configured by a hearing device fitter. The basic sound classes may be provided to the hearing device during manufacturing and/or with a special software that is used by the hearing device fitter.

An adjusted sound class structure may ease further fine tuning. Oscillating settings for different sound types of a sound class may be avoided. Unwanted side-effects caused by fine tuning may be avoided.

If the new sound class structure turns out in the course of time as no longer sufficient (for example, when the number of adjustments increases by e.g. 10%), the method may be partly or completely repeated.

Hearing device fitter may get a tool for improving fitting quality and reducing effort for fine tuning.

If data of such re-structured sound class structures of many hearing device users is collected, these data may be used for and fed into further development of classifiers and/or sound processors. A predefined sound class structure may be optimized to the needs of the majority of hearing device users and/or adapted to the needs of certain groups of hearing device users.

According to an embodiment of the invention, with the basic sound classes, the at least one hearing device is adapted for: classifying an acquired sound signal with respect to the basic sound classes by generating an actual weighting in which each basic sound class is weighted with a basic weight value; generating an actual actuator parametrization for at least one actuator by interpolating the actuator parametrization of the basic sound classes at the actual weighting; processing the acquired sound signal with the at least one actuator parametrized with the actual actuator parametrization; outputting the processed sound signal to be perceived by a user of the hearing device; and modifying the actual actuator parametrization based on adjustments of sound properties of the user.

The sound signal, which may be acquired with a loudspeaker and/or may be received in the hearing device otherwise, for example from a telecoil or via Bluetooth, may be classified by one or more classifiers. These classifiers may produce a weight value for each basic sound class, which weight value is called basic weight value. A weight value may be a value between 0 and 1. With the weight values, the basic sound classes may define a weight space, which is spanned by all possible weight values for all basic sound classes.

When the actual sound situation is a mixture of sound situations, which have been used for defining the basic sound classes, there may be weight values different from 0 and 1 for more than one sound class. The classifiers may determine a mixture of basic sound classes. The classification and/or actual weighting may be a point in the weight space. When only basic sound classes are present, the hearing device may interpolate between these sound classes, for example by linearly interpolating with the weights the actuator parameters of the actuator parametrizations provided by the sound classes. In the case supplementary sound classes are present, the determination of the actual actuator parametrization may be performed as described below.

The actual actuator parametrization is then applied to the actuators, which process the sound signal accordingly. In the end, the processed sound signal may be output, for example via a loudspeaker or a cochlea implant.

The actual actuator parametrization of the hearing may be adjusted based on adjustments of sound properties of the user. A sound property may be a quality of the sound situation and/or the outputted sound signal, which may be directly adjusted by the user via the hearing device. For example, the hearing device may provide means for directly adjusting the sound property, such as a lever, a knob, etc. The sound property also may be adjusted via a visual user interface of a smartphone in communication with the hearing device. Examples for sound properties are loudness and noise canceller. With an adjustment, the loudness and/or the noise canceller of the outputted sound signal may be increased and increased.

It has to be noted that for adjusting the sound property, the hearing device may transform the adjusted sound property into adjusted actuator parameters. In other words, due to the adjustment of the sound property, the actual actuator parametrization may be adjusted.

Returning now to the method steps, which may be performed by an external system, an adjustment of a sound property by the user may be sent to the external system, which collects the adjustments. Each adjustment and/or the corresponding actuator parametrization may be stored together with the actual weighting of the sound classes determined by the classifiers, at the time, the adjustment was made.

The collected adjustments may be analyzed, whether same adjustments have been applied at same weightings. For example, it may be that many users make same adjustment (such as more loudness) at the same weighting (such as 50% speech in noise and 50% music). This analysis may be made automatically, for example with statistical methods.

When a point in weight space is identified, at which the same adjustment has been applied frequently, a supplementary sound class may be generated. As a basic sound class, a supplementary sound class may comprise an actuator parametrization. However, a supplementary sound class does not define a corner point of the weight space, but may be associated with weighting, i.e. with a point within the weight space. The actuator parametrization of the supplementary sound class is a modified actuator parametrization based on the adjustments at the weighting, i.e. the actuator parametrization of the supplementary sound class may be the actuator parametrization after the adjustment of the user has been applied.

With the method, a usage-related and systematic procedure for generating, verifying and revising a predefined actuator steering for certain sound situations may be provided. The adjustments of one user or of a plurality of users may be analyzed to identify regions in weight space, where similar adjustments are made. When such a region is identified, the hearing device (or a plurality of hearing devices) can be automatically adjusted, such that no further user adjustments are necessary for achieving the same hearing experience.

Furthermore, the automatic adjustments are made with supplementary sound classes, which unify the storage and/or application of automated adjustments at specific points and/or regions in weight space.

In one approach (which may be called big data approach), the sound class structure of a plurality of hearing devices may be revised and adjusted based on a plurality of data about occurring and/or solved hearing issues, which may be reflected in the collected user adjustments. These data may be collected by means of a big data platform. Collecting and analyzing such data may allow a verification of the predefined sound class structure and may give advice for revising this predefined sound class structure.

In a second approach (which may be called individual approach), the sound class structure of one hearing device may be revised and adjusted based on the data collected by the individual hearing device. Here, the data may be collected, analyzed and/or the supplementary sound class may be generated by the hearing device itself or a computing device communicatively connected to the hearing device, such as a fitting device, a smartphone and/or the above-mentioned big data platform.

According to an embodiment of the invention, when at least one supplementary sound class is present, the hearing device generates the actual actuator parametrization by interpolating the actuator parametrization of the basic sound classes and the actuator parametrization of the at least one supplementary sound class at the actual weighting of the sound signal. The parameters of the actual actuator parametrization, which are applied to the one or more actuators, may be determined by (for example linearly) interpolating the parameters of the actuator parametrizations of the basic and/or supplementary sound classes in a region around the actual weighting. A sound class may be in a region around the weighting, when in weight space its weighting is in a region around the actual weighting in weight space.

According to an embodiment of the invention, a supplementary sound class is generated, when more than 80% of the adjustments at the weighting are within a significant range of adjustments. When a point and/or region in weight space is found, where a plurality of adjustments have been made, the adjustments may have to be compared to decide, whether the same adjustments have been made by the one or more users. To this end, the adjustments, which, for example, are encoded with numerical values, may be statistically analyzed and/or a statistical distribution of the adjustments may be made. When a large amount, such as more than 80% or more than 90% are in a significant range around a maximum of the statistical distribution, then a supplementary sound class may be generated. The supplementary sound class may be defined for the center of the region in weight space and/or with an actuator parametrization determined from the maximum of the statistical distribution of the adjustments.

As described above, a supplementary sound class may be generated, when the same adjustments of sound properties have been applied at the same weightings. Here, the term "same" need not mean absolutely equal, but may apply to ranges and/or specific properties. I.e. two adjustments may be the same, when they are nearly equal. It also may be that adjustments are equal, when they apply to the same sound property. Furthermore, two weightings may be equal, when their weight values are all nearly equal. Two values may be nearly equal, when their difference is smaller than a threshold that is small compared to the whole range of possible values. As an example, the threshold may be 10% of the whole range.

According to an embodiment of the invention, two adjustments are the same, when the same sound property has been adjusted. This may be independent from a value to which the sound property has been adjusted.

According to an embodiment of the invention, two adjustments are the same, when adjustment parameters for a sound property are within a specific range and/or are smaller than a threshold. For example, a specific range may refer to positive values of an adjustment parameter and/or a specific range may refer to negative values of an adjustment parameter. The threshold may be determined with a standard deviation from a statistical mean value. It also may be that two adjustments are considered as the same, when the sound property has been adjusted in the same direction, such as increased or decreased.

According to an embodiment of the invention, two weightings are the same, when their weights have a distance smaller than a threshold in a weight space. This threshold may be determined with a statistical analysis. The distance may be determined with a standard deviation of weightings from a cluster point in weight space.

According to an embodiment of the invention, during analyzing, a weighting is identified at which adjustments for different sound properties are applied. For determining possible supplementary sound classes, in a first step, a region and/or point in weight space may be identified, where a plurality of adjustments have been made (in particular independently of the type of adjustment). Such a point/region in weight space may be seen as a sound situation, where many users are not content with the behavior of the hearing device and/or with the mixing of the sound classes.

In a second step, the types of adjustments at the point and/or in the region may be analyzed to determine, which adjustments have been made the more often. Furthermore, the duration and/or the times of the adjustments may be used for determining, which adjustments were satisfying and which not.

According to an embodiment of the invention, times and/or durations of adjustments are collected. Not only the adjustment itself, but also the time point at which the adjustment has been made by the user may be collected. Also the duration, how long the adjustment has been used by the user, i.e. the time until the user has made a further adjustment to the same sound property, may be determined and collected.

According to an embodiment of the invention, the supplementary sound class is generated based on adjustments of the same sound property at the identified weighting, which adjustments have been applied the most often and/or with the longest duration. It may be assumed that such adjustments were the one with the highest user satisfaction.

According to an embodiment of the invention, at a weighting at least two supplementary sound classes are generated. It also may be that different supplementary sound classes are provided and/or are present at the same weighting. This may be the case, when with statistical methods two different sound classes have been derived in the same region and/or at the same point in weight space. For example, different sound properties have been adjusted at the same weighting.

According to an embodiment of the invention, when an actual weighting is generated, which is associated with at least two supplementary sound classes, the two supplementary sound classes are offered to the user for selecting the supplementary sound class, which is used for generating the actual actuator parametrization. When the actual weighting, determined from the actual sound situation, approaches and/or is near (i.e. in a region around) the weighting of the at least two supplementary sound classes, the user is offered to choose one of the sound classes. In such a way, the user can choose the supplementary sound class, which better fits his or her needs.

It also may be that the supplementary sound classes at a weighting are prioritized, for example with respect of how often the corresponding adjustments have been made by the one or more users.

In general, the method may comprise: logging and storing of adjustments, together with data about the sound situation, which is active, when an adjustment or modification is applied, such as the weighting of the one or more classifiers; analysis of logged and stored adjustments regarding their occurrence within comparable sound situations; determination of priority of adjustments, which were applied within comparable sound situations, regarding their occurrence; and definition of a sequence, in which the supplementary sound classes corresponding to the adjustments are offered, according to a determined priority.

According to an embodiment of the invention, a plurality of hearing devices for a plurality of users are provided with the basic sound classes, wherein adjustments of the plurality of hearing devices are collected and analyzed, wherein the supplementary sound class is provided to the plurality of hearing devices. As already mentioned, the method may be employed in a big data approach, in which a plurality of hearing devices and users may be involved.

According to an embodiment of the invention, the method further comprises: modifying a basic sound class, when a plurality of users has applied the same adjustments at a weighting corresponding the basic sound class, wherein the parametrization of the modified basic sound class is a modified actuator parametrization based on the adjustments at the weighting. It also may be that a basic sound class is modified with the information collected from a plurality of users. When adjustments are applied in sound situations, which are pure, i.e. when the actual weighting is in a region near (within a specific threshold) around the weighting of a basic sound class, it may be assumed that the sound class has to be redefined. This may be done in the same way as for a supplementary sound class.

A further aspect of the invention relates to an interpolation structure for a hearing device. The interpolation structure may be a data structure stored in the hearing device adapted for interpolation between sound classes.

The interpolation structure may be used in the method as described herein. However, the interpolation structure also may be used independently of how the supplementary sound classes and/or the actuator parametrizations have been determined. For example, the interpolation structure also may be used for storing actuator parametrizations that have been generated directly from adjustments of a user.

According to an embodiment of the invention, the interpolation structure stores the actuator parametrization of at least one supplementary sound class. It also may store the actuator parametrization of the basic sound classes. Basically, the interpolation structure may be adapted for associating sound classes to points in a weight space and/or for finding sound classes in a region around a specific weighting in the weight space.

According to an embodiment of the invention, the actual actuator parametrization is determined by interpolating between the actuator parametrizations stored in the interpolation structure. When an actual weighting is determined, the sound classes nearest to the weighting, which may span a non-degenerate region around the actual weighting in the weight space, may be determined. Here, non-degenerate may mean that the region has the same dimension as the weight space. The parameters from the actuator parametrizations of the sound classes in the region may be linearly interpolated to determine the actual actuator parametrization.

According to an embodiment of the invention, the interpolation structure comprises fix points in a weight space, at which fix points the actuator parametrizations for each sound class are stored. A possibility is that the interpolation structure comprises a list of fix points, which have a reference to the respective sound class. Every time a new supplementary sound class at a new weighting is stored in the interpolation structure, the point may be appended to the list.

According to an embodiment of the invention, the actual actuator parametrization is determined with interpolation functions between the fix points. The interpolation functions may be linear or of higher order, such as splines.

According to an embodiment of the invention, the interpolation structure comprises a grid of grid points in a weight space and the actuator parametrizations of the sound classes are stored at the grid points. At every grid point, a reference to one or more sound classes may be set. A further possibility is that a fixed number of grid points is set. The distance between grid points may be a fixed value. It may be that the weighting of a sound class is set to the nearest grid point, when the sound class is stored in the interpolation structure.

According to an embodiment of the invention, the actual actuator parametrization is determined by multiplying parameters of an actuator parametrization of a sound class with a weight function. It has to be noted that the weight function is used for weighting an actuator parametrization and does not comprise weights of the classification of a sound signal.

The multiplication with a weight function is a further possibility of determining the actual actuator parametrization from the sound classes stored in the hearing device. For example, a basic actual actuator parametrization may be determined by interpolating the actuator parametrization of the basic sound classes with the actual weighting.

Each supplementary may be associated with a weight function. The actuator parametrization of the supplementary sound class, i.e. its parameters, may be multiplied with the weight function evaluated at the actual weighting (which usually may be different from the weighting of the supplementary sound class). Then an average (i.e. an average of the parameters) of the actuator parametrization of the sound class weighted with the weight function and the basic actual actuator parametrization may be determined as actual actuator parametrization.

Alternatively and/or additionally, the actuator parametrization of a supplementary sound class may comprise offset values to the basic actuator parametrization at the weighting of the supplementary sound class. In this case, the actuator parametrization of the sound class weighted with the weight function (determined for the actual weighting) may be added to basic actuator parametrization d determined for the actual weighting.

According to an embodiment of the invention, the weight function is 1 at the point in weight space at which the actuator parametrization for the sound class is stored. The weight function may decrease with increasing distance from the point and/or the weight function may be 0 outside an impact region for the sound class. The weight function may be formed like a bell-curve or higher dimensional analogue.

According to an embodiment of the invention, the hearing device is a hearing aid. A hearing aid may be adapted to compensate a hearing loss of a user. The method may provide an optimized classification of sound for a hearing impaired user.

Further aspects of the invention relate to a computer program for adjusting a hearing device, which, when being executed by a processor, is adapted to carry out the steps of the method as described in the above and in the following as well as to a computer-readable medium, in which such a computer program is stored.

For example, the computer program may be executed in a processor of a hearing device, which, for example, may be carried by the person behind the ear. The computer-readable medium may be a memory of this hearing device. In this memory, also the interpolation structure may be stored.

In general, a computer-readable medium may be a floppy disk, a hard disk, an USB (Universal Serial Bus) storage device, a RAM (Random Access Memory), a ROM (Read Only Memory), an EPROM (Erasable Programmable Read Only Memory) or a FLASH memory. A computer-readable medium may also be a data communication network, e.g. the Internet, which allows downloading a program code. The computer-readable medium may be a non-transitory or transitory medium.

A further aspect of the invention relates to a hearing system, which comprises an evaluation system and at least one hearing device.

The evaluation system may be one or more servers, which, for example, may provide a big data platform. Alternatively, the evaluation system may be a fitting device for fitting the hearing device. The evaluation system also may be a smartphone used for configuring the hearing device and/or may be part of the hearing device.

According to an embodiment of the invention, the evaluation system is adapted for: providing the at least one hearing device with basic sound classes, each basic sound class comprising an actuator parametrization with parameters for at least one actuator of the at least one hearing device; collecting of adjustments of sound properties applied by a user of the at least one hearing device together with weightings at which the adjustments have been made; analyzing the collected adjustments, whether same adjustments have been applied at same weightings; generating at least one supplementary sound class, when the same adjustments have been applied at a weighting, wherein the parametrization of the supplementary sound class is a modified actuator parametrization based on the adjustments at the weighting. Optionally, the evaluation system is adapted for providing the at least one hearing device with the at least one supplementary sound class.

According to an embodiment of the invention, the at least one hearing device is adapted for: classifying an acquired sound signal with respect to the basic sound classes by generating an actual weighting in which each basic sound class is weighted with a basic weight value; generating an actual actuator parametrization for at least one actuator by interpolating the actuator parametrization of the basic sound classes based on the weighting; processing the acquired sound signal with the at least one actuator parametrized with the actual actuator parametrization; outputting the processed sound signal to be perceived by a user of the hearing device; and modifying the actual actuator parametrization based on adjustments of sound properties of the user.

It has to be understood that features of the method as described in the above and in the following may be features of the computer program, the computer-readable medium, the hearing system, evaluation system, the hearing device and/or the interpolation structure as described in the above and in the following, and vice versa.

These and other aspects of the invention will be apparent from and elucidated with reference to the embodiments described hereinafter.

BRIEF DESCRIPTION OF THE DRAWINGS

Below, embodiments of the present invention are described in more detail with reference to the attached drawings.

The reference symbols used in the drawings, and their meanings, are listed in summary form in the list of reference symbols. In principle, identical parts are provided with the same reference symbols in the figures.

DETAILED DESCRIPTION OF EXEMPLARY EMBODIMENTS

Hearing System

Figure 1:
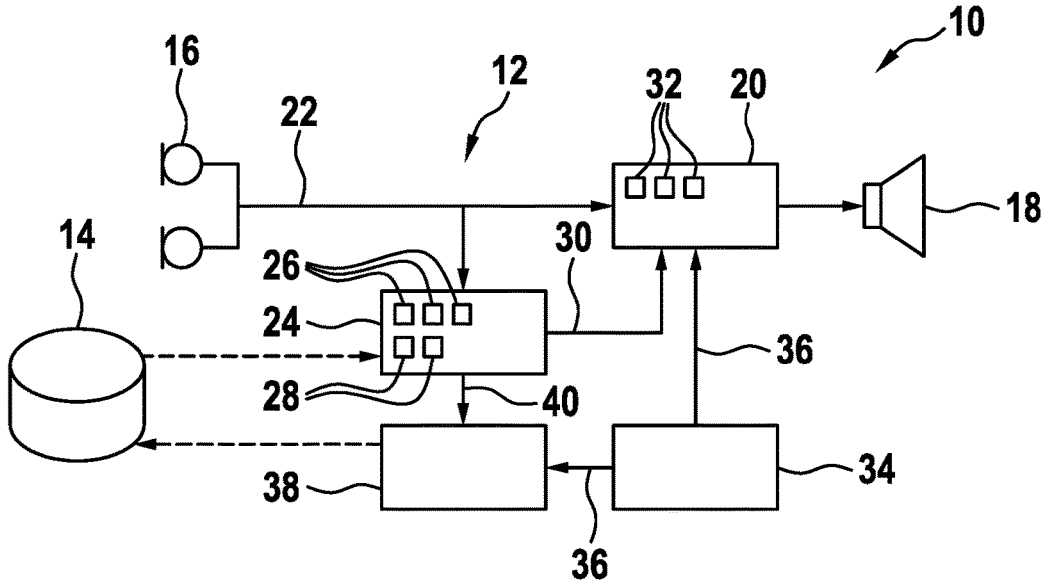
FIG. 1 schematically shows a hearing system according to an embodiment of the invention.

FIG. 1 shows a hearing system 10 comprising a hearing device 12 and an evaluation system 14. The hearing device 12 and the evaluation system 14 may be interconnected via a communication connection, for example via Internet. It also may be that the evaluation system 14 is part of the hearing device and/or of a further device used for controlling and/or configuring the hearing device 12, such as a fitting device or a user device like a smartphone.

The hearing device 12 comprises one or more microphones 16 with input transducer, one or more output devices 18 with an output transducer, such as loudspeaker or cochlea implant, and a sound processor 20. The sound processor receives a sound signal 22 from the microphone 16 and processes it to compensate a hearing loss of a user of the hearing device 12. The processed sound signal 22 is the output by the output device 18.

The hearing device 12 furthermore comprises a sound classifier 24, which also receives the sound signal and classifies it into sound situations. For specific sound situations basic sound classes 26 are present, with respect to which, the classifier 24 determines an actual weighting. Additionally, supplementary sound classes 28 may be present, which may correspond to a mixture of the specific sound situations. From the weighting and the sound classes 26, 28, the classifier determines an actual actuator parametrization 30, which is applied to actuators 32 of the sound processor 20.

Each actuator 32, such as a noise filter or beam former, may receive one or more parameters of the actual actuator parametrization 30. Each actuator 32 may process the sound signal 22 in dependence of the parameters applied to it. Such parameters may include a frequency to be filtered, a direction of a beam, an amplifier coefficient, etc.

The hearing device 12 furthermore comprises a control unit 34, which may be used for adjusting the hearing device 12 by the user. With the control unit 34, which may be part of the hearing device 12 and/or which may be provided by a further user device, such as a smartphone, the user may perform adjustments 36 of sound properties, such as loudness, noise canceller, etc. The adjustments 36 may modify the actual actuator parametrization 30.

The hearing device 12 also comprises a logging unit 38, which receives at least the actual weighting 40 and the adjustments 36 of the user and sends them to the evaluation system 14. As the control unit 34, the logging unit 38 may be part of the hearing device 12 and/or may be provided by the further user device.

The evaluation device 14 receives the logged data, such as 36, 40, from the logging unit 38, collects them and analyses them. Based on the analysis, the evaluation device 14 may generate one or more supplementary sound classes 28, which are then provided to the hearing device 12.

Hearing Device Operation

Figure 2:
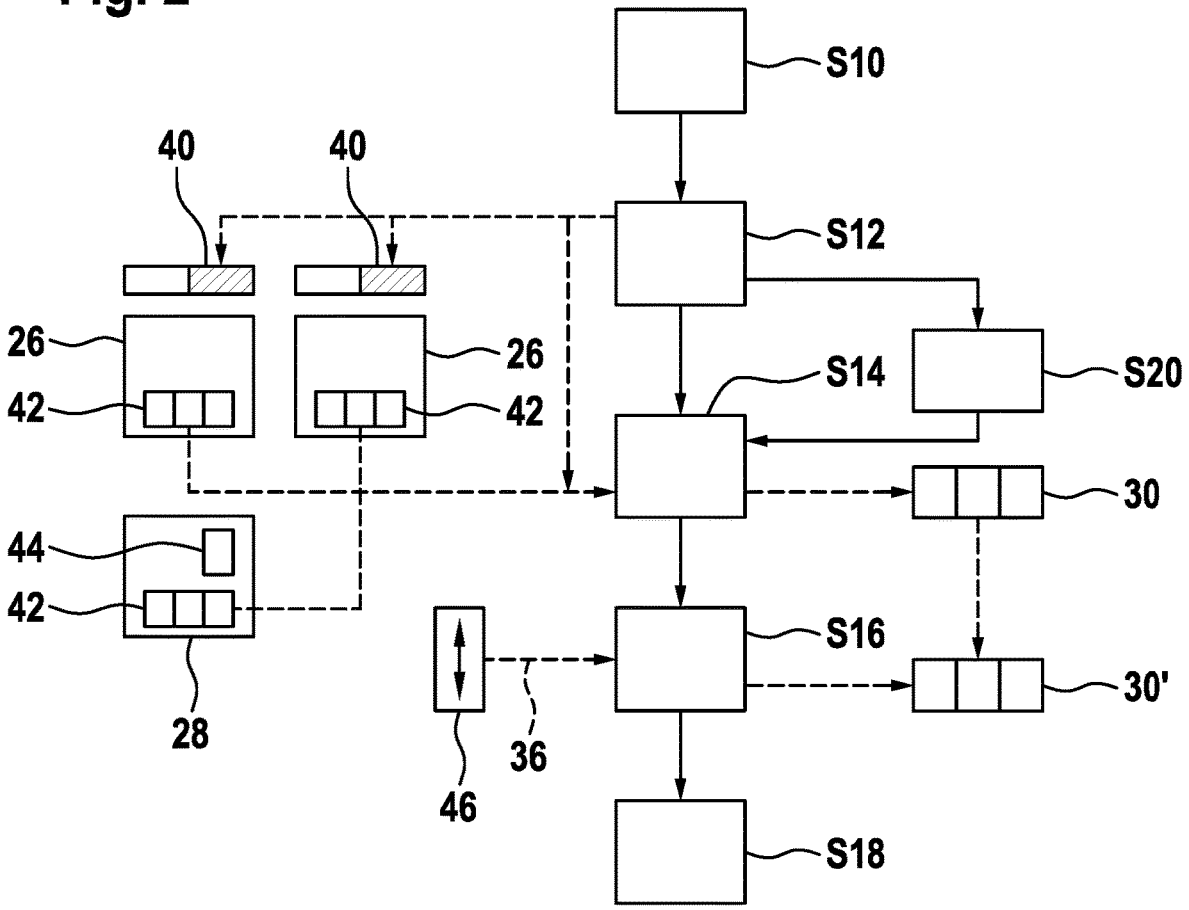
FIG. 2 shows a flow diagram for operating a hearing device.

FIG. 2 shows a flow diagram of a method of operating the hearing device 12, which may be performed by the hearing device of FIG. 1.

In step S10, the hearing device 12 acquires a sound signal 22. The sound signal may be a digitized signal, which may be provided by the transducer of the microphone 16. The sound signal 22 also may be provided from another source, such as a telecoil, or from the user device, such as a sound signal from a microphone of the user device or from a telephone call.

In step S12, the classifier 24 classifies the acquired sound signal 22 with respect to the basic sound classes 26 by generating an actual weighting 40, in which each basic sound class is weighted with a basic weight value.

A sound class 26, 28 may be seen as a container or a data structure for a plurality of similar sound types, such as "speech in noise", "music", etc., which is assigned to a corresponding actuator parametrization 42. To each sound class 26, 28, a specific actuator parametrization 42 is associated.

Basic sound classes 28 may be predefined by the manufacturer of the hearing device 12 and may be assigned to "speech in noise", "car noise", "noise", "music", etc. A sound type may be a sound, which is representative for a certain sound situation, e.g. a dialogue in a noisy restaurant, classical music, etc. A sound situation may be a concrete situation, which contains sound from one or several sound sources.

In step S14, the hearing device 12 generates an actual actuator parametrization 30 for at least one actuator 32 by interpolating the actuator parametrization 42 of the basic sound classes 26 and optionally of one or more supplementary sound classes 28 with the actual weighting 40.

A supplementary sound class 28 may be a sound class for a sound situation, which requires a specific actuator parametrization 42, which cannot be predicted by mixing actuator parametrizations 42 of basic sound classes. Therefore, a supplementary sound class 28 has an associated weighting 44 (which comprises weight values for every basic sound class).

With the actual weighting 40, the classifier 24 interpolates between the actuator parametrization of the basic sound classes 26 and the supplementary sound class(es) 28, where for the supplementary sound class(es) 22 additionally the weighting 44 is used. As nearer the actual weighting 40 to the associated weighting 44 is, as stronger is the influence of the supplementary sound class 28 to the actual actuator parametrization.

In optional step S16, the hearing device 12 receives an adjustment 36 of a sound property, which, for example, may have been performed with a control element 46 of the control unit 34, such as a lever, knob or element of a visual user interface of a user device. The adjustment 36 may contain a value indicating an intended change in a sound property, such as loudness, noise suppression, etc. Based on the adjustment 36, the actual actuator parametrization 40 is adapted and/or modified into a modified actual actuator parametrization 40'.

In step S18, the sound processor 20 processes the acquired sound signal 22 with the at least one actuator 32 parametrized with the optionally modified actual actuator parametrization 40'. The output device 18 then outputs the processed sound signal 22 to be perceived by the user of the hearing device 12.

It may be that the user can actively choose between supplementary sound classes 28. This may be the case, when two supplementary sound classes 28 have the same weighting 44 but have different actuator parametrizations 42.

In this case, optional step S20 may take place. Step S20 is performed, after the actual weighting 40 has been determined and when it has been determined that two sound classes at the same weighting 44 (which may be near the actual weighting 40) may affect the actual actuator parametrization 30. In step S20, the user is notified that two different supplementary sound classes 28 are present and the user then can choose one of the supplementary sound classes 28, for example with the control unit 34.

In other words, when an actual weighting is classified, which is associated with at least two supplementary sound classes, the two supplementary sound classes may be offered to the user for selecting the supplementary sound class, which is used for generating the actual actuator parametrization.

Hearing Device Adjustment

Figure 3:
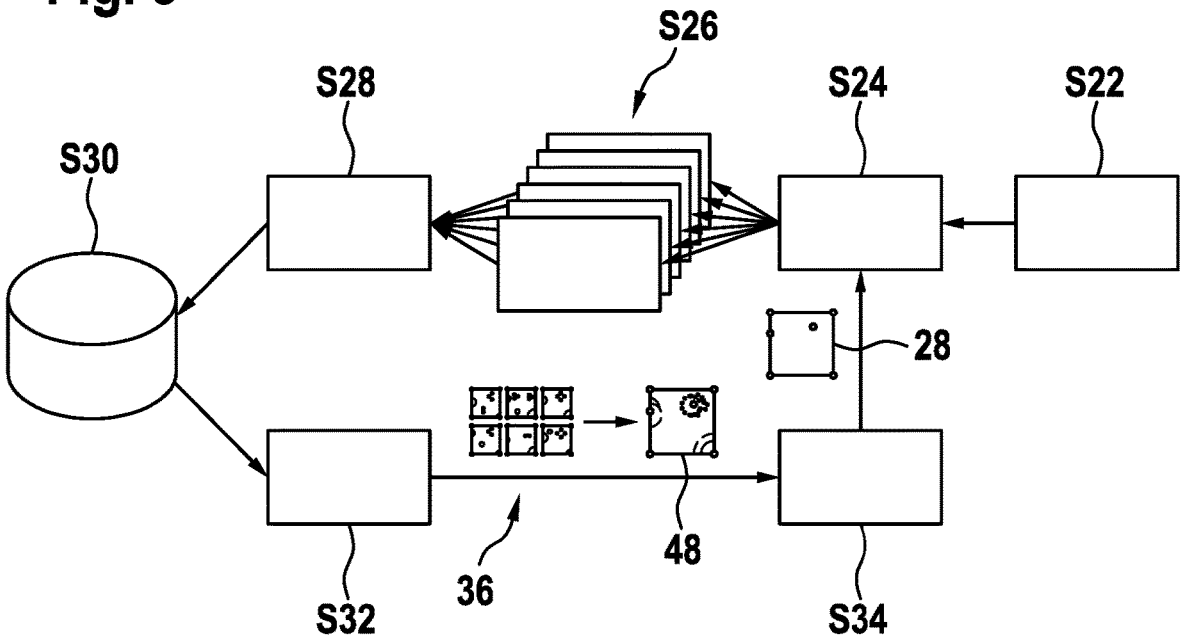
FIG. 3 shows a flow diagram for adjusting a hearing device according to an embodiment of the invention.

FIG. 3 shows a method for adjusting the hearing device 12 and/or for determining new supplementary sound classes 28.

In step S22, the basic sound class structure is developed and predefined in development process by the manufacturer.

In step S24, the sound class structure is applied in one or more hearing devices 12. At least one hearing device 12 is provided with basic sound classes 26, wherein each basic sound class 26 comprises an actuator parametrization 42 with parameters for at least one actuator 32 of the hearing device 12. For example, the basic sound classes 26 may be stored in the hearing device 12, when the hearing device is manufactured and/or when the hearing device is configured for the first time by an audiologist.

In step S26, the one or more hearing devices 12 are used by many users and/or in many sound situations. For every hearing device 12, the method shown in FIG. 2 may be performed. One or more users are exposed to different sound situations, which result in different weightings 40 and/or actual actuator parametrizations 30. The one or more user apply adjustments 36, when they are not satisfied with the quality of the processed audio signal 22.

In step S28, hearing device usage, performance data, sound environment and/or adjustment data may be collected and sent to the evaluation system 14, which may be a big data platform. In particular, actual weightings and adjustments at these weightings may be sent to the evaluation system 14. Furthermore, the times at which adjustments 35 have been made and/or the durations, how long specific adjustments 36 have been used also may be sent to the evaluation system 14.

In step S30, the evaluation system 14 collects usage, performance, sound environment and/or adjustment data and stores them in a database. In particular, the adjustments 36, their time and durations together with weightings 40 at which the adjustments 36 have been made may be stored in the database.

In step S32, the evaluation system 14 analyses the collected data. The collected adjustments 36 are analyzed, whether same adjustments 36 have been applied at same weightings 40. As indicated in FIG. 3, adjustment patterns 48 may be generated and cluster points of adjustments in weight space may be identified. This will be described in more detail with respect to FIGS. 4 and 5.

A data analysis may comprise a collecting of all adjustments 36, which have been applied to a specific region within the weight space and/or averaging (or for example counting, compiling a histogram of, etc.) the applied adjustments 36. An adjustment 36 is applied to the specific region or in the specific region, when the actual weighting 40 at which this adjustments has been made is within the specific region in weight space. Adjustments 36 in the specific region may be considered as having the same weighting 40.

If significant deviations from the original actuator parametrization 42 (such as 6 dB) for this region exist or count of concordant and/or same adjustments 36 is very high (such as more than 80% or more than 90%), this region may become a candidate for a new supplementary sound class 28.

Also effects caused by acclimatization of first time hearing device users (which information may be received from a fitting software or from the user him/herself) may be considered. Adjustments 36 applied by first time users may be excluded from analysis. The analysis also may be performed separately for different user groups, such as mild, moderate, severe hearing impaired users with different exposition to specific sound situations.

Such analyses may be qualitative or quantitative analyses. Such an analysis may be performed automatically by a computer or an expert system, or also manually by a data analyst.

The evaluation system 14 may derive adjustment patterns 48 based on analyzed data. An adjustment pattern 48 may be a reduction of global gain, an increase of high pitch gain, an increase in strength of noise canceller, a reduction in strength of beam former for a specific region within the weight space. In general, adjustment patterns 48 may be common patterns of specific adjustments 48 within a specific region, which suggest a revision of the actuator parametrization 42 in the region. Such a revision may be made with a supplementary sound class 28. Such adjustment patterns 48 (which also may be seen as heatmaps) can be compiled for certain situations and/or user groups and/or hearing activities.

In step S34, the evaluation system 14 derives proposals for new supplementary sound classes 26 and/or new basic sound classes 26, which may be applied to the one or more hearing devices 12.

The more similar adjustments 36 are applied to a specific certain sound situation (represented by a weighting of basic sound classes 26, such as 65% "speech" and 35% "speech in noise"), the more probable is a need for a supplementary sound class 28 for treating this sound situation. Application of adjustments indicate, that simply mixing of basic sound class settings for this sound situation may not sufficiently fulfill the demands of the users.

At least one supplementary sound class 28 may be generated, when the same adjustments 36 have been applied at a weighting 44, wherein the actuator parametrization 42 of the supplementary sound class 28 is a modified actuator parametrization based on the adjustments 36 at the weighting 44.

It also may be possible that in step S34, a basic sound class 26 is modified, when a plurality of users has applied the same adjustments 36 at a weighting corresponding the basic sound class 26, wherein the parametrization 42 of the modified basic sound class 26 is a modified actuator parametrization based on the adjustments 36 at the weighting.

In general, a supplementary sound class 28 may be derived from an adjustment pattern 48. The weighting of the supplementary sound class 28 may be a center and/or point in the region of the adjustment pattern 48 in weight space. The actuator parametrization 42 may be derived from an average of the adjustments of the adjustment pattern 48.

It also may be possible that the evaluation system 14 proposes new supplementary sound classes, which may be provided to the user and/or to the fitter for deciding to become applied or not. New supplementary sound classes 28 may be integrated into the hearing device 12 and/or may be provided as manual programs and/or may be offered in parallel to the previous configuration of the actuator parametrization 42 at this weighting for direct comparison by switching between both alternatives.

In a big data approach, a plurality of hearing devices 12 for a plurality of users are provided with the basic sound classes 26 and are employed in the method for collecting and analyzing the data. Adjustments 36 of the plurality of hearing devices 12 are collected and analyzed. When a new supplementary sound class 28 is generated, the supplementary sound class 28 may be provided to each of the hearing devices 12. A big data approach may allow collecting a plurality of data about adjustments 36 (such as N>1000 or N>10000 or N>100000 different adjustments).

In an individual approach, only the data of one hearing device 12 belonging to one user is collected and analyzed. The number of such adjustments may be (N>10 or N>50). However, the same method may be used in this case as in the big data approach. Due to the much smaller amount of data, the collection of data and its analysis may be performed in a user device (such as a smartphone, a remote control), etc., but also in an evaluation system 14, which may be located in the cloud.

In the individual case, the reactive determination of the supplementary sound class structure is performed during daily life usage of the hearing device, the hearing device user may apply adjustments during the use of his or her hearing device in real life. All adjustments 36 as well as sound type characteristic and optionally hearing activity may be logged in the hearing device 12 and/or a user device (such as a smartphone, a smartwatch, etc.) or any other linked memory location (such as a cloud server).

An evaluation system 14 may generate supplementary sound classes as in the big data approach. This may result in a new/rearranged sound class structure, which may be optimized to the individual needs of the hearing device user. The number of new supplementary sound classes 28 may be limited to a specific amount (such as 2, 3 or 4), which can be handled by the hearing device software.

Data Analysis

It may be seen as a goal of the method not to redefine the classifier 24 of the hearing device 12, but to redefine the mapping of actuator parametrizations 30 on detected sound environments.

Figure 4:
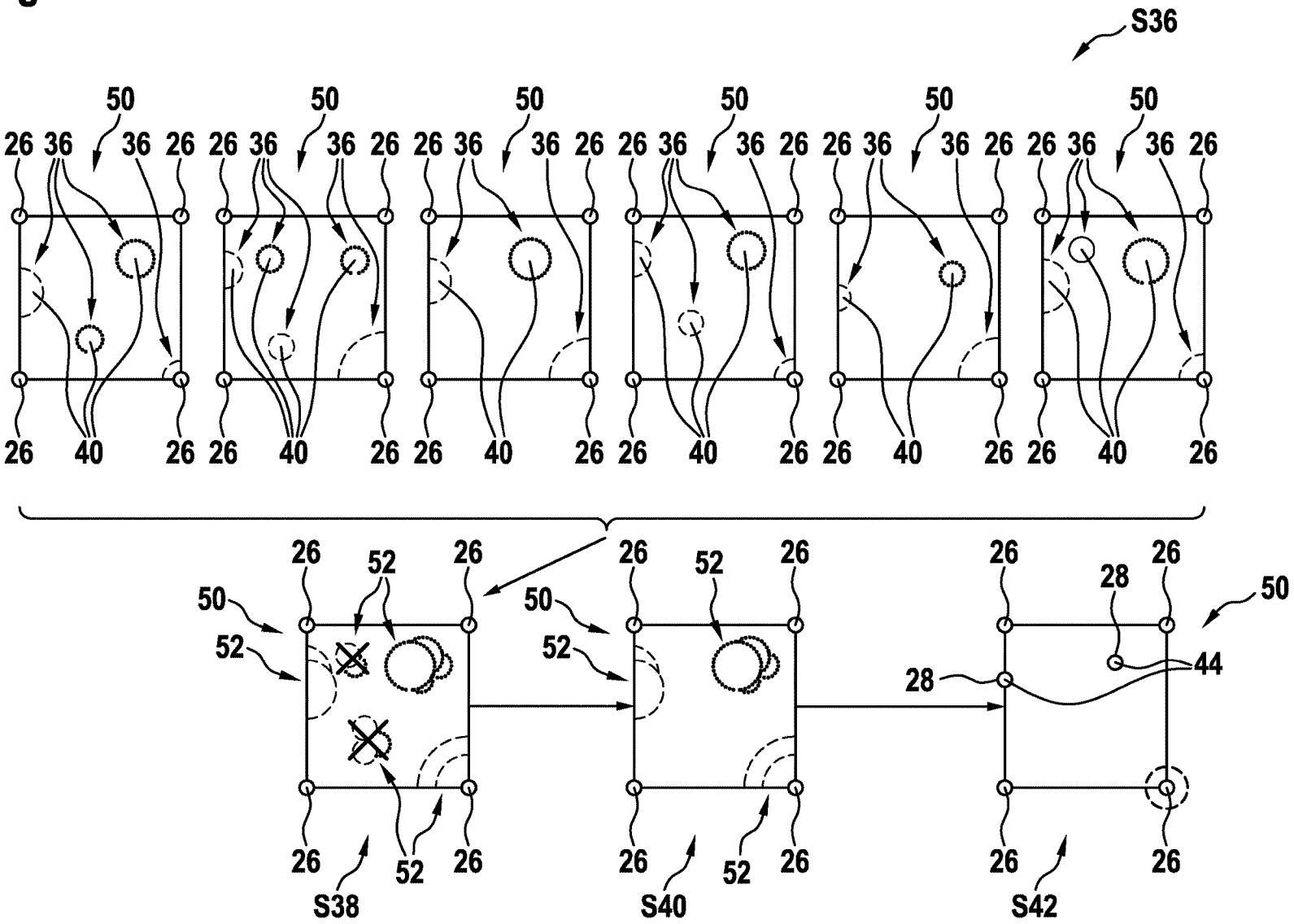
FIG. 4 illustrates a method for generating one or more new supplementary sound classes according to an embodiment of the invention.

FIG. 4 illustrates a method for generating one or more new supplementary sound classes 28. The method may be performed completely or at least partially by the evaluation system 14.

FIG. 4 shows several times an illustration of a weight space 50 spanned by the possible weightings 30 produced by the classifier 24. The basic sound classes 26 are located at the corners of the weight space 50. A weighting 30, which is composed of a weight or weight value for every basic sound class 26, is a point within the weight space 50. It has to be noted that the weight space 50 may be a higher dimensional space with more than two dimensions.

The illustration of the weight space 50 is also used to illustrate adjustments 36 by a user, which are indicated as circles of different sizes. Every adjustment is made at a specific weighting 30, which is indicated by the center of the circle.

In FIG. 4, two types of adjustments 36, such as loudness and noise canceller, are illustrated. Both types of adjustment 36 depend on a parameter. Big circles indicate a large absolute value of the parameter and small circles a small absolute value. The dotted circles indicate the first type of adjustment 36. The dashed circles indicate a second type of adjustment 36.

In step S36, the evaluation system 14 collects adjustment data from a large number/plurality of users. In FIG. 4, the adjustments of 6 users are shown. For every user, a weight space 50 is shown with the adjustments 36, the user has made. Basically, the weighting 30 at which the adjustment 36 has been made and the parameter of the adjustment 36 may be collected and stored in a database.

In step S38, the system identifies adjustment patterns 52. An adjustment pattern 52 may be a region in the weight space 50, where many adjustments 36 optionally of the same type have been made. Here, the term "many" may refer to clustering the adjustments 36 with statistical methods and/or identifying regions, where adjustments are present within a specific radius around a cluster point.

During analyzing, a weighting 40 may be identified at which adjustments 36 for different sound properties are applied. The weighting 40 may be the center of a region of the identified adjustment pattern 52.

In step S40, the evaluation system 14 identifies consistent adjustment patterns 52. For example, adjustments patterns 52 comprising adjustments 36 of different types and/or with an adjustment parameter in different ranges may be discarded.

As an example, an adjustment pattern 52, where "more loudness" is applied by more than 90% of the users may be consistent. An adjustment pattern 52 with "more loudness" applied by 40% of the users and "less loudness" applied by 45% of the users may be inconsistent and may be discarded. Also, an adjustment pattern 52 with "more noise canceller" applied by 35% of the users and "less noise canceller" applied by 65% of the users may be inconsistent and may be discarded.

In summary, same adjustments 36 with the same weightings 30 may be identified as an adjustment pattern 52, which may be used for defining a supplementary sound class 26. Two weightings 30 may be the same, when they are in the same region and/or when their weights have a distance smaller than a threshold in the weight space 50, i.e. they may be in a (hyper)sphere. Two adjustments 36 may be the same and/or of the same type, when the same sound property, such as loudness, has been adjusted. It also may be that two adjustments 36 are the same, when adjustment parameters for a sound property are smaller than a threshold and/or within the same range.

In step S42, the evaluation system 14 derives a proposal for a new sound class structure and in particular proposes new actuator parametrizations 42 for sound classes 26, 28 from identified consistent adjustment patterns 52. For example, a supplementary sound class 28 may be generated, when more than 80% of the adjustments 36 at the weighting 40 are within a significant range of adjustments 36.

The adjustment prediction data (such as the adjustments 36) may be translated into actuator parametrizations 42, which may be mapped to the specific sound situation.

For an adjustment pattern 52 within the weight space 50, a supplementary sound class 28 may be derived. The weighting 44 of the supplementary sound class 28, i.e. its position in weight space 50, may be a center of the region of the adjustment pattern 52. The actuator parametrizations 42 of the supplementary sound class 28 may be derived from a mean value of the adjustments of the adjustment pattern 52.

For an adjustment pattern 52 at a basic sound class, a modified basic sound class 26 may be derived. The actuator parametrizations 42 of the modified basic sound class 26 also may be derived from a mean value of the adjustments of the corresponding adjustment pattern 52.

Figure 5:
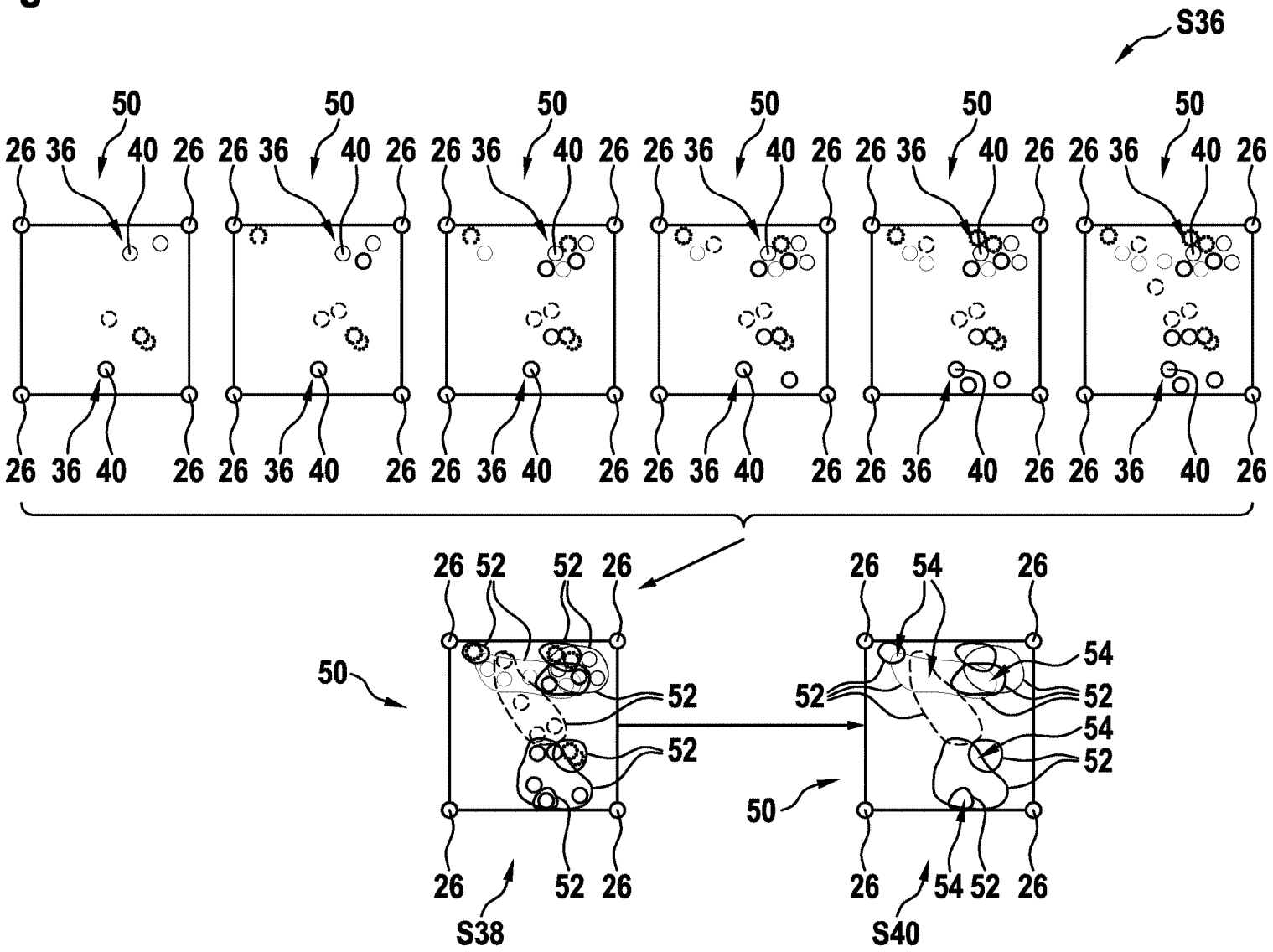
FIGS. 5 and 6 illustrate a method for generating one or more new supplementary sound classes according to a further embodiment of the invention.
Figure 6:
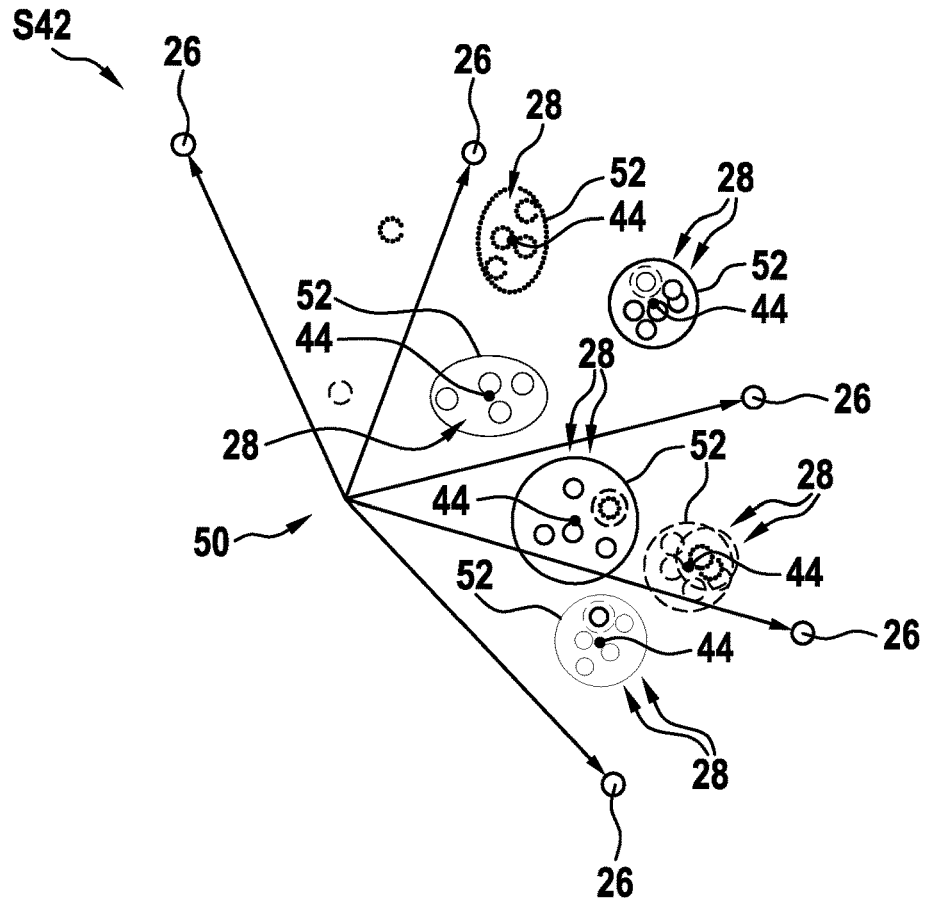

FIGS. 5 and 6 illustrate a method for generating one or more new supplementary sound classes 28 according to a further embodiment of the invention. The method of FIG. 5 is based on the fact, that users often are motivated to explore their hearing device 12 for a certain time, before motivation and also preoccupation with their hearing device 12 decreases. At least during this time, self-fitting tools, such as the control unit 34, may log every adjustment 36 as well as optionally additional information, like the sound situation as well as success and perceived benefit of an adjustment 36.

In step S36, adjustment data of one user is collected over time. Contrary to this, in the method of FIG. 4, the adjustment data of many users is collected. The method of FIG. 4 and the method of FIG. 5 may be combined. For example, adjustment data may be collected for a plurality of users over time.

In step S35, the adjustments 36 of the user during six weeks are shown. The weight space diagrams from the left to the right show an increasing number of different adjustments 36 of different types, such as loudness, bass, treble, noise canceller, beam former direction, sound recover, etc.

In general, the adjustment data may be logged and collected over a certain time duration, such as days, weeks or months. Additionally, times and/or durations of the adjustments 36 may be logged and collected.

The adjustments 36 may be successful or unsuccessful adjustments. The question, if an adjustment 36 is successful or not, can be answered either by observing e.g. how long an adjustment 36 remains applied (i.e. its duration) or by directly asking the user, for example by means of a short questionnaire, which may be implemented on an external control unit 34, such as a smartphone. Also, the property of an adjustment 36 being successful or not may be collected.

In step S38, the evaluation system 14 identifies adjustment patterns 52, for example as described with respect to FIG. 4. The collected adjustments 36 are analyzed and regions of sound situations are identified, where certain adjustments 36 have been applied in the course of time. If adjustments 36 are similar or "the same" (according to predefined criteria for similarity), these adjustments 36 may be summed up as a single group of comparable adjustments 36.

In FIG. 5 it is shown that adjustments of the same type may be clustered into adjustment patterns 52 and/or that the region in weight space 50 need not be a hypersphere, but may be irregularly formed. Such regions also may be determined with sophisticated statistical methods, such as reproducing kernel methods.

In step S40, the evaluation system 14 identifies consistent adjustment patterns 52. Regions within the weight space 50 are identified, where certain adjustments 36 are applied frequently and successfully. As in FIG. 4, this may be regions, where only one type of adjustment 36 has been made and/or where most of the adjustments (more than 80%) have been determined as successful either by the user and/or by the evaluation system 14 based on the durations of the adjustments 36. As shown in FIG. 5, it may be that the regions of consistent adjustment patterns 52 overlap in overlapping regions 54.

Turning to FIG. 6, in step S42, the evaluation system 14 derives a proposal for a new sound class structure, for example as in FIG. 4. FIG. 6 shows a different illustration of the weight space 50, which indicates that the weight space may have a dimension with respect to each sound class 26. In FIG. 6, also adjustment patterns 52, which have been identified in step S40, are shown.

The new supplementary sound classes 28 may be generated based on adjustments 36 of the same sound property at the identified weighting 40, which adjustments 36 have been applied the most often and/or with the longest duration.

It also may be that at a weighting 44 at least two supplementary sound classes 28 are generated. This may be for adjustment regions with overlapping regions 54. For example, in a region of the weight space 50, three different types of adjustments 36 were collected: adjustments 36 of sound recover, bass and noise canceller. The sound recover adjustments 36 were logged most frequently, the second most frequent adjustments 36 were bass, and the third most frequent adjustments 36 were noise canceller. Therefore, three supplementary sound classes 28 may be generated at a weighting 44 in the center of the region.

When the supplementary sound classes 28 have been provided to the hearing device 12 and/or stored in the hearing device 12, they may not be automatically used for determining the actual actuator parametrization 30. When an actual weighting 40 is classified, which is associated with at least two supplementary sound classes 28, the two supplementary sound classes 28 are offered to the user for selecting the supplementary sound class 28, which is used for generating the actual actuator parametrization 30.

The analysis procedure in step S38 may consider the frequency, a certain adjustment 36 in a certain weight space region has been applied over time. If the frequency is high, a priority of this adjustment 36 may be also high. If frequency is low, either the priority is also low. The priority of the corresponding adjustments 36 may be used for defining a priority of the supplementary sound class 28. A sequence of supplementary sound classes 28 may be offered to the user. So the probability for providing the 'right' adjustment may increase.

Supplementary sound classes 28 with high priority may be automatically offered, when the hearing situation occurs again. Supplementary sound classes 28, which did not lead to a successful adjustment 36 and/or which have a lower priority, may be only offered on explicit request by the user.

The decision, whether a supplementary sound class is generated, besides considering frequency of application of a certain adjustment 36, may be based on additional information about the success of the adjustments 36 of the adjustment pattern 52, which may define a supplementary sound class 28. A measure for success may be the duration, how long an adjustment 36 has been applied, until it is withdrawn, or a statement of the user (which may be collected by asking the users by means of a question displayed on a smartphone).

Interpolation Structure

Each of the pure sound classes 26, 28 may be seen as a program of the hearing device 12 for a specific sound situation. In general, an interpolation structure or mixing structure (with data and program code) may be implemented in a hearing device 12, which is adapted to tune a program cluster (i.e. several mixable programs), which is in a mixing mode (i.e. only partial effect of each of the mixed programs), so that a tuning action at the mixture point is understandable by the user, that an adjusted actuator parametrization 30 can get re-activated by fine-granular automatic classification of the hearing device 12 and that adjustments 36 of the user can be stored with reasonable memory requirements in the hearing device 12.

One solution to reproduce the actuator parametrization 30 that has been adjusted by a user, would be to exactly store the weighting 40, when the user is tuning and re-apply these end-user triggered adjustments 36 to the hearing device 12, whenever the exact same weighting 40 is identified by the classifier 24. However, in this solution, the actuator parametrization 30 near the weighting 40 would stay the same.

A further solution may be to force the weighting 40 to the closest weighting 44, where a sound class 26, 28 is stored.

Herein, the solution described for determining the actuator parametrization 30 at the actual weighting 40 is to interpolate between actuator parametrizations 42 of sound classes 26, 28.

Figure 7:
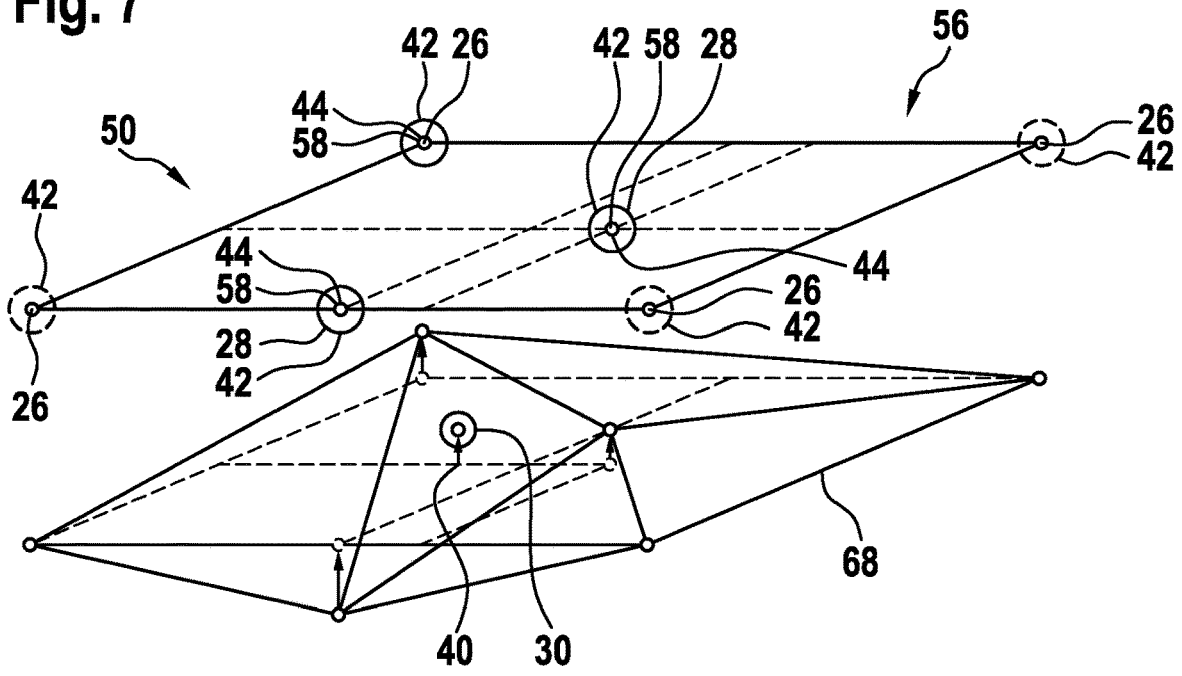
FIG. 7 shows a diagram illustrating an embodiment of an interpolation structure used in the hearing system and the methods of FIGS. 1 to 6 according to embodiments of the invention.
Figure 8:
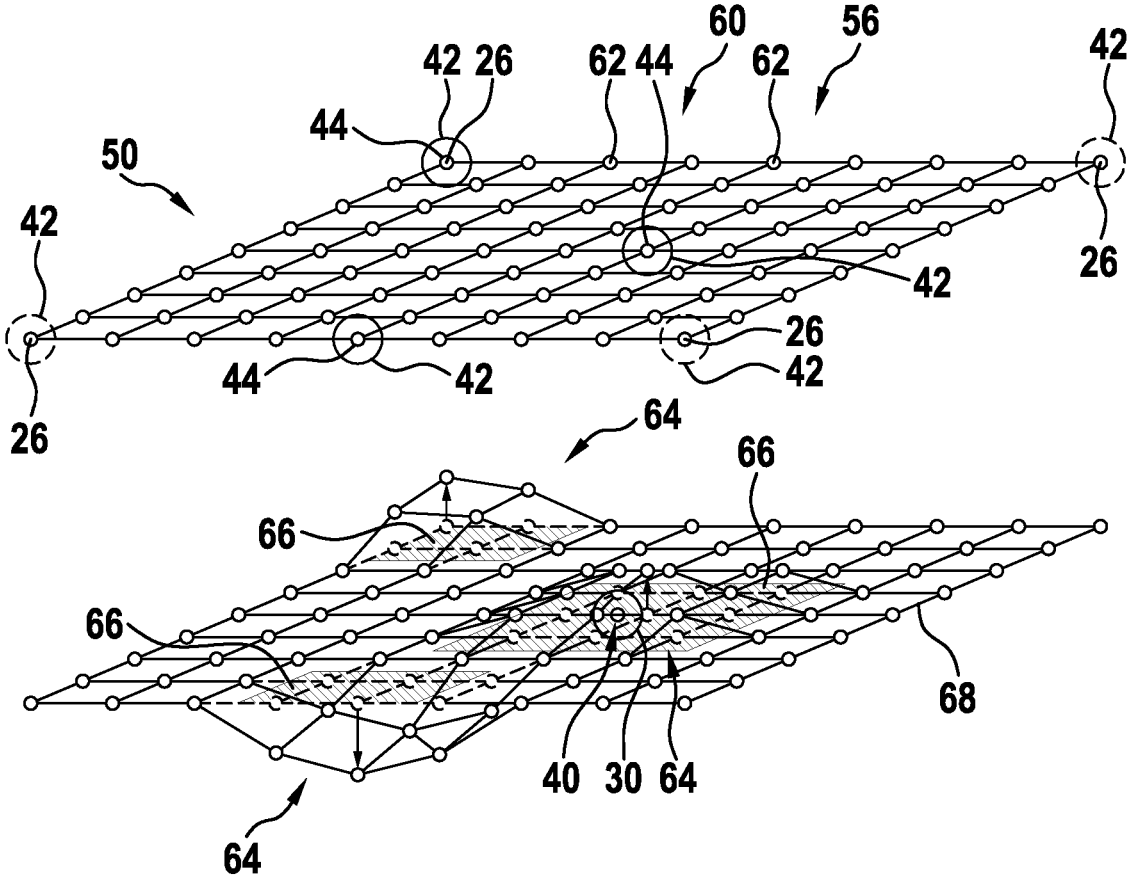
FIG. 8 shows a diagram illustrating a further embodiment of an interpolation structure used in the hearing system and the methods of FIGS. 1 to 6 according to embodiments of the invention.

FIGS. 7 and 8 show diagrams illustrating an interpolation structure 56, which may be used for storing the basic sound classes 26 and the one or more supplementary sound classes in the hearing device 12 and/or which may be used for determining an actual actuator parametrization 30 from the actual weighting 40 classified by the classifier 24. The interpolation structure 56 may comprise a data structure for storing the data of the sound classes 26, 28. In particular, the interpolation structure 56 may store the actuator parametrization 42 of the at least one supplementary sound class 28. The interpolation structure 56 may comprise program code for calculating the actual actuator parametrization 30 from the actual weighting 40. In particular, the actual actuator parametrization 30 may be determined by interpolating between the actuator parametrizations 42 stored in the interpolation structure 56.

In FIG. 7, an interpolation structure 56 is based on fix points 58. The fix points 58 may be seen as points in the weight space spanned by the weightings that may be produced by the classifier 24. In FIG. 7, the upper part of the diagram show the weight space 50 as quadrangle. However, the weight space 50 in general may be a higher dimensional space with the numbers of corners equal to the number of basic sound classes 26.

As shown, the interpolation structure 56 comprises fix points 58 in a weight space 50, at which fix points 58 the actuator parametrizations 42 for each sound class 26, 28 are stored. For a supplementary sound class 28, the fix points 58 may be equal to the weighting 44 that has been determined for the supplementary sound class 28.

For example, if the analysis in step S40 shows systematic adjustments 36 for specific positions (i.e. weightings 40) within the interpolation structure 56, these positions may become fix points 58 for new supplementary sound classes 28. The mixing of sound classes 26, 28 then accordingly considers these new fix points 58.

The lower part of FIG. 7 shows the graph for one parameter 68, which is the result of interpolating the sound classes 26, 28 in weight space. The upper part may be seen as describing a sensory part of the hearing device 12 (such as the classifier 24 and the sound classes 26, 28). The lower part of the diagram may be seen as describing an actuator system of the hearing device 12 (such as the sound processor 20 with the actual actuator parametrization 30 derived from the sound classes 26, 28).

The actual actuator parametrization 30 at the actual weighting 40 may be determined with interpolation functions between the fix points 58. In FIG. 7, linear interpolation functions are used. When a specific actual weighting 40 is determined, the nearest sound classes 26, 28 around the actual weighting 40, which span a non-degenerate region of the weight space 50, may be determined and the parameters of the sound classes are interpolated with theses sound classes 26, 28. Here, linear functions between these sound classes 26, 28 and/or splines may be used.

FIG. 8 shows a diagram analogous to FIG. 7, with an upper part illustrating the weight space 50 with the sound classes and a lower part with a graph of one interpolated parameter 68 in the weight space 50.

In FIG. 8, the interpolation structure 56 comprises a grid 60 of grid points 62 in the weight space 50 and the actuator parametrizations 42 of the sound classes 26, 28 are stored at the grid points 62. A supplementary sound class 28, which is based on adjustments 36 that have one or more weightings 40 close to a grid point 62, may be assigned to this grid point 62.

A grid point 62 may be defined by a specific weighting 40 in the weight space 62. The interpolation structure 56 may be structured by a predefined grid pattern. The grid points 62 of the grid 60 may be spaced equidistant in one or more directions and/or may be arranged in a regular pattern, such as a hypercubic pattern.

The weight space 50 may be divided into a discrete grid 60 with well-defined grid points 62 at which interpolation and/or a mixture may take place. The granularity of the grid 60 may be lower than the granularity of the actual weightings 40 the hearing device 12 is able to provide. The granularity of the grid 60 may be defined fine enough to prevent drastic changes in perception, when a user listens to the hearing device output. Thus, the granularity of the grid 60 may be coarser in regions of the weight space, where the perceptual difference for interpolation between the base sound classes 26 is small, and finer in regions that would lead to bigger perceptual changes in between the basic sound classes.

In general, a granularity of the grid 60 in a region of the weight space 50 may be adapted to a perceptual difference for a user, when interpolation basic sound classes 26 in this region. The grid granularity may be coarser than the actual granularity of weightings 40 produced by the classifier 24 of the hearing device 12. This may help, when limited storage capabilities of the hearing device 12 are present.

A grid point 62 with an assigned sound class 26, 28 may be treated as a fix point 58 of an interpolation structure 56 as described with respect to FIG. 7 and the actual actuator parametrization 30 may be determined from the grid points 62 as described with respect to FIG. 7.

However, with the grid 60, also a certain shape (i.e. impact region 66) around a grid point 62 may be defined, which specifies how an actuator parametrization 44 may have to be modified for the impact area 66 around the grid point 62.

An extrapolation of an actuator parametrization 42 at a grid point 62 into the impact region 66 around the grid point 62 (which may be seen as an interpolation within the weight space 50) may be performed by a weight function 56 with defined slope or matching, such as a Gaussian bell curve. A region outside the impact region 66 may not be affected.

The weight function 64 may be 1 at the grid point 62 in weight space 50 at which the actuator parametrization 42 for the sound class 26, 28 is stored. The weight function 64 may be decreasing with increasing distance from the grid point 62. The weight function 64 may be 0 outside the impact region 66 for the supplementary sound class 28. The weight function 64 may be linear between the grid points 62.

The actual actuator parametrization 30 at an actual weighting 40 may be determined by firstly determining the actuator parametrization(s) 42 of one or more of the sound classes 26, 28, which have an impact area 66 at the actual weighting 40. Each of these determined actuator parametrization(s) 42 may be multiplied with the weight function 64 defined for the weighting of the sound class 26. In the end, an average of the weighted actuator parametrization(s) 42 may be used as actual actuator parametrization 30. This solution may allow a much more specific mixing of hearing device settings and/or sound classes 26, 28 as the solution of FIG. 7.

It has to be noted that the previous calculation (i.e. weighting and averaging) may be performed for each of the parameters of the actuator parametrization 42. Furthermore, it may be that differently sized impact regions 66 and/or different weight functions 64 are used for different types of actuator parameters. In general, the actual actuator parametrization 30 may be determined by multiplying parameters 68 of an actuator parametrization 42 of a basic sound class 26 and/or a supplementary sound class 28 with a weight function 64.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art and practising the claimed invention, from a study of the drawings, the disclosure, and the appended claims. In the claims, the word "comprising" does not exclude other elements or steps, and the indefinite article "a" or "an" does not exclude a plurality. A single processor or controller or other unit may fulfill the functions of several items recited in the claims. The mere fact that certain measures are recited in mutually different dependent claims does not indicate that a combination of these measures cannot be used to advantage. Any reference signs in the claims should not be construed as limiting the scope.

LIST OF REFERENCE SYMBOLS

10 hearing system
12 hearing device
14 evaluation system
16 microphone
18 output device
20 sound processor
22 sound signal
24 sound classifier
26 basic sound class
28 supplementary sound class
30 actual actuator parametrization
30' modified actual actuator parametrization
32 actuator
34 control unit
36 adjustment
38 logging unit
40 actual weighting
42 actuator parametrization associated with sound class

44 weighting associated with supplementary sound class
46 control element
48 adjustment pattern
50 weight space
52 adjustment pattern
54 overlapping region
56 interpolation structure
58 fix point
60 grid
62 grid point
64 weight function
66 impact region
68 parameter

The invention claimed is:

1. A method for adjusting at least one hearing device, the method comprising:

providing the at least one hearing device with basic sound classes, each basic sound class comprising an actuator parametrization with parameters for at least one actuator of the hearing device;

wherein the at least one hearing device;

classifies an acquired sound signal with respect to the basic sound classes by generating an actual weighting in which each basic sound class is weighted with a basic weight value;

generates an actual actuator parametrization for at least one actuator by interpolating the actuator parametrization of the basic sound classes at the actual weighting;

processes the acquired sound signal with the at least one actuator parametrized with the actual actuator parametrization;

outputs the processed sound signal to be perceived by a user of the hearing device;

modifies the actual actuator parametrization based on adjustments of sound properties of the user;

wherein the method further comprises:

collecting of adjustments of sound properties together with weightings at which the adjustments have been made;

analyzing the collected adjustments, whether same adjustments have been applied at same weightings;

generating at least one supplementary sound class, when the same adjustments have been applied at a weighting, wherein the actuator parametrization of the supplementary sound class is a modified actuator parametrization based on the adjustments at the weighting.

2. The method of claim 1, wherein, when at least one supplementary sound class is present, the hearing device generates the actual actuator parametrization by interpolating the actuator parametrization of the basic sound classes and the actuator parametrization of the at least one supplementary sound class at the actual weighting of the sound signal.

3. The method of claim 1, wherein a supplementary sound class is generated, when more than 80% of the adjustments at the weighting are within a significant range of adjustments.

4. The method of claim 1, wherein two adjustments are the same, when the same sound property has been adjusted;

wherein two adjustments are the same, when adjustment parameters for a sound property are within a specific range;

wherein two weightings are the same, when their weights have a distance smaller than a threshold in a weight space.

5. The method of claim 1, wherein times and/or durations of adjustments are collected;

wherein during analyzing, a weighting is identified at which adjustments for different sound properties are applied;

wherein the supplementary sound class is generated based on adjustments of the same sound property at the identified weighting, which adjustments have been applied the most often and/or with the longest duration.

6. The method of claim 1, wherein at a weighting at least two supplementary sound classes are generated;

wherein, when an actual weighting is classified, which is associated with at least two supplementary sound classes, the two supplementary sound classes are offered to the user for selecting the supplementary sound class, which is used for generating the actual actuator parametrization.

7. The method of claim 1, wherein a plurality of hearing devices for a plurality of users are provided with the basic sound classes;

wherein adjustments of the plurality of hearing devices are collected and analyzed;

wherein the supplementary sound class is provided to the plurality of hearing devices.

8. The method of claim 1, further comprising:

modifying a basic sound class, when a plurality of users has applied the same adjustments at a weighting corresponding the basic sound class, wherein the parametrization of the modified basic sound class is a modified actuator parametrization based on the adjustments at the weighting.

9. The method of claim 1, wherein the hearing device comprises an interpolation structure storing the actuator parametrization of the at least one supplementary sound class;

wherein the actual actuator parametrization is determined by interpolating between the actuator parametrizations stored in the interpolation structure;

wherein the interpolation structure comprises fix points in a weight space, at which fix points the actuator parametrizations for each sound class are stored.

10. The method of claim 9, wherein the actual actuator parametrization is determined with interpolation functions between the fix points.

11. The method of claim 9, wherein the interpolation structure comprises a grid of grid points in a weight space and the actuator parametrizations of the sound classes are stored at the grid points.

12. The method of claim 9, wherein the actual actuator parametrization is determined by multiplying parameters of an actuator parametrization of a supplementary sound class with a weight function;

wherein the weight function is 1 at the point in weight space at which the actuator parametrization for the supplementary sound class is stored;

wherein the weight function is decreasing with increasing distance from the point;

wherein the weight function is 0 outside an impact region for the supplementary sound class.

13. The method of claim 1, wherein the hearing device is a hearing aid.

14. A non-transitory computer-readable medium storing a computer program for adjusting a hearing device, which, when being executed by a processor, is adapted to carry out the steps of claim 1.

15. A hearing system, comprising an evaluation system and at least one hearing device, the evaluation system being adapted for:

providing the at least one hearing device with basic sound classes, each basic sound class comprising an actuator parametrization with parameters for at least one actuator of the at least one hearing device;

collecting of adjustments of sound properties applied by a user of the at least one hearing device together with weightings at which the adjustments have been made;

analyzing the collected adjustments, whether same adjustments have been applied at same weightings;

generating at least one supplementary sound class, when the same adjustments have been applied at a weighting, wherein the actuator parametrization of the supplementary sound class is a modified actuator parametrization based on the adjustments at the weighting;

providing the at least one hearing device with the at least one supplementary sound class;

wherein the at least one hearing device is adapted for:

classifying an acquired sound signal with respect to the basic sound classes by generating an actual weighting in which each basic sound class is weighted with a basic weight value;

generating an actual actuator parametrization for at least one actuator by interpolating the actuator parametrization of the basic sound classes based on the actual weighting;

processing the acquired sound signal with the at least one actuator parametrized with the actual actuator parametrization;

outputting the processed sound signal to be perceived by a user of the hearing device;

modifying the actual actuator parametrization based on adjustments of sound properties of the user.

* * * * *